United States Patent [19]

Holzman

[11] 3,999,478

[45] Dec. 28, 1976

[54] TYPE CARRIER

[75] Inventor: Richard Holzman, Framingham, Mass.

[73] Assignee: Iomec, Inc., Santa Clara, Calif.

[22] Filed: July 13, 1973

[21] Appl. No.: 378,970

Related U.S. Application Data

[63] Continuation of Ser. No. 857,507, Sept. 12, 1969, abandoned.

[52] U.S. Cl. ..... 101/111; 101/93.14

[51] Int. Cl.[2] ..... B41J 1/20

[58] Field of Search ..... 101/110, 111, 93 C

[56] References Cited

UNITED STATES PATENTS

| | | | |
|---|---|---|---|
| 2,936,704 | 5/1960 | Hense | 101/93 C |
| 3,041,965 | 7/1962 | Sasaki | 101/111 |
| 3,115,092 | 12/1963 | Sasaki | 101/111 X |
| 3,133,497 | 5/1964 | Martin | 101/111 X |
| 3,216,348 | 11/1965 | Oldenburg et al. | 101/111 X |
| 3,314,360 | 4/1967 | Foster | 101/93 C X |
| 3,363,238 | 1/1968 | Clark | 101/93 C X |
| 3,453,954 | 7/1969 | Pandolfi | 101/93 C |
| 3,457,855 | 7/1969 | Falchero | 101/93 C |
| 3,467,005 | 9/1969 | Bernard | 101/93 C |

OTHER PUBLICATIONS

"Type Belt Permits Two Line Printing," Design News, Mar. 2, 1959.

*Primary Examiner*—Edward M. Coven
*Attorney, Agent, or Firm*—Daniel M. Rosen

[57] ABSTRACT

A printer employing a steel band having type and control indicia etched along one surface. A variable reluctance transducer senses the control indicia to properly time the operation of the printer. The transducer contains an axial pole and a concentric cylindrical pole, in which are located a coil and a cylindrical magnet.

6 Claims, 4 Drawing Figures

RICHARD HOLZMAN
INVENTOR.

BY Francis J. Thomas
ATTORNEY.

TYPE CARRIER

This is a continuation of application Ser. No. 857,507, filed Sept. 12, 1969, now abandoned.

BACKGROUND OF THE INVENTION

High-speed, on-the-fly printers have employed type carriers of the kind which move across the document along the line to be printed while print hammers are selectively actuated. These devices generally contain type slugs which are clamped or otherwise mounted on a flexible carrier such as a timing belt. Alternatively, a train of type can be guided along a specially-constructed track and a supporting carrier is not required. The construction of these devices is complex and expensive because the type must move along the line to be printed at a relatively high speed and the exact location of each type element along the line is critical to avoid misregistration of the resultant printing. It is particularly important that the type carrier not buckle or stretch and that the type slugs remain firmly attached to the carrier as the hammers impact the type.

BRIEF DESCRIPTION OF THE INVENTION

In the present invention, the type is etched or otherwise formed on a band of steel which is then welded together at its ends to form a closed loop. Since the type and the carrier are formed from a homogeneous material, the band is sturdy and the type is permanently and precisely located on the carrier. The band is formed, not only with type elements, but also with control indicia which are precisely located with respect to the type.

The band is supported by two pulleys, one adjacent to each end of the line to be printed. The band contains two straight portions between the pulleys and the assembly is positioned in the printer such that one straight portion of the band is close to the document and along the line to be printed. One pulley is driven by an electric motor, the other pulley is an idler supported by an adjustable mounting which permits the band to be removed and replaced and the tension of the band to be adjusted.

The control indicia are sensed by a transducer while the band is in operation in order to control the operation of the printer.

DETAILED DESCRIPTION OF THE PREFERRED EMBODIMENT OF THE INVENTION

The preferred embodiment of the invention is shown in detail in the drawings, where:

Figure 1:
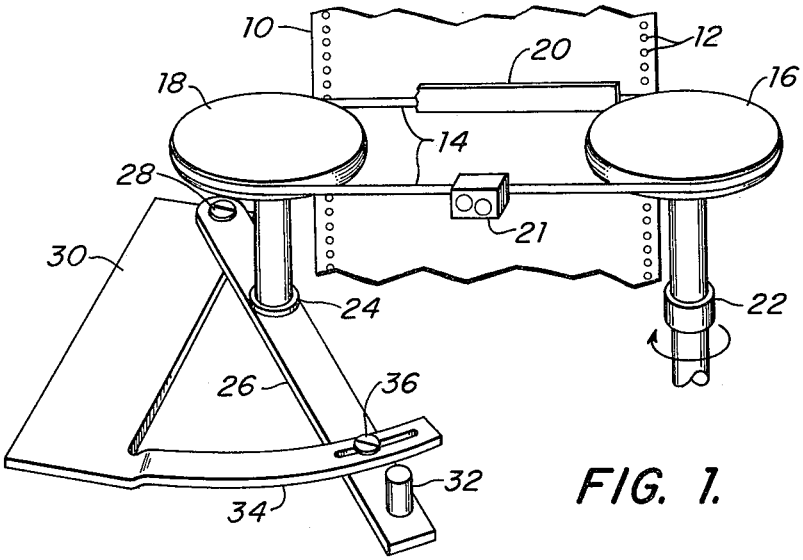
FIG. 1 is a functional diagram showing the band, its supports and the transducer assembly.

In the printer shown in FIG. 1, a document 10 to be printed is stepped upward, a line at a time, by standard paper feed devices operating on marginal perforations 12. Print hammers are located behind the document, one for each column to be printed. Suitable hammers are described in a U.S. Pat. No. 3,780,648.

The inventive type carrier consists of an etched band 14 supported by a drive pulley 16 and an idler pulley 18. The pulleys are crowned to accurately maintain the band 14 in the appropriate vertical position. Alternatively, flanged pulleys may be used. The band contains raised type and control indicia to be described in detail below. A back-up plate 20 (shown partially cut-away) extends along the printing line on the side of the band 14 that is opposite to the document. The back-up plate provides a solid bearing surface to prevent flexing of the band when the hammers strike the document against the type. A printing ribbon (not shown) is located between the document 10 and the band 14.

The position of the band is sensed by transducers mounted in a housing 21 that is located adjacent to the carrier. The transducers sense the exact position of the type to provide control signals to time the actuation of the print hammers.

The drive pulley 16 is mounted for rotational movement in a bearing 22 and is driven at a constant speed by a motor (not shown). The follower pulley 18 is also mounted for rotational movement in a bearing 24 on an adjustable arm 26. The arm is rotatable about a pivot 28 on a portion 30 of the printer frame. The position of the arm 26 is manually adjusted with a handle 32. When the arm is properly adjusted, it is held firmly to a slotted extension 34 of the frame by tightening a locking screw 36.

The band 14 is removed by moving the arm 26 toward the right until the band can clear the pulleys. The arm 26 also permits the tension on the band to be adjusted.

The mounting and adjustment of the band are shown functionally by simple apparatus because there are many well-known structures that are suitable for driving a steel band.

Figure 2:
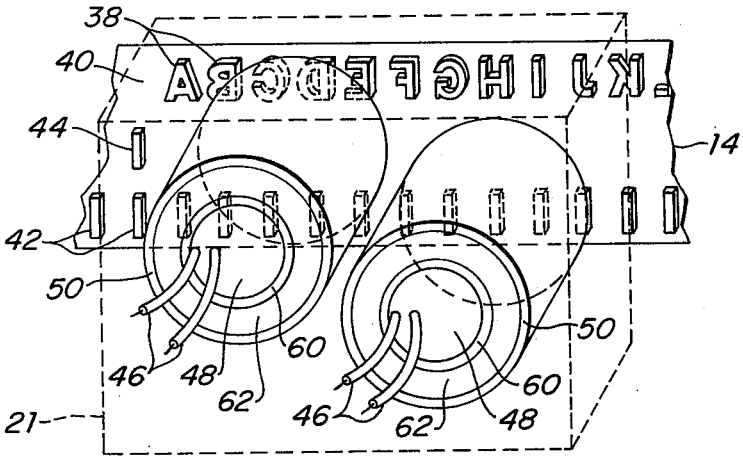
FIG. 2 is an enlarged isometric view of the transducer assembly and a portion of the band.

The band 14 and the transducer housing 21 are shown in greater detail in FIG. 2. Raised type 38 are aligned in a row at a pre-determined distance from an edge of the band. The type is preferably located as close as possible to the upper edge of the band so that the resultant printing can be viewed while the next line, or the line thereafter, is being printed. Two or more rows of type can be formed on one band if desired. For example, a row of type can be formed near each edge of the band and the band reversed in position on the pulleys when it is desired to change from one row of type to the other. Alternatively, the entire pulley assembly can be raised and lowered to select a row of type.

In the preferred embodiment of the invention, the band is 48 inches long, containing six fonts of 63 type characters spaced on one-eighth inch centers with a blank space 40 between each font of type. Raised, elongated control indicia 42 are aligned in another row along the length of the band, where each control indicia corresponds to a type element (or to the space between type elements) and is located along the band at precisely the same position as the center of the corresponding type element. Along another row on the band is a single control indicia 44 for each font of type on the band. These indicia are located to correspond to the blank space 40 between fonts. The use of two rows of control indicia permits standard printer circuitry to establish the identify and position of each character along the printing line.

A single row of control indicia can also be employed, where a control indicia corresponds to each type element along the band except for one position in each font (such as the position corresponding to the blank space 40. The printer circuitry is modified to recognize a new font by the absence of a pulse at the anticipated time instead of by an additional pulse.

The band 14 is constructed of magnetic stainless steel and is approximately 0.005 inch thick. The type elements and control indicia are raised about 0.010 inch to provide a total thickness of about 0.015 inch. The band is preferably formed by etching magnetic stainless steel stock of the appropriate thickness. Standard etching techniques are suitable, such as applying a photoresist to the area which is not to be etched (corresponding to the type and control indicia) and carefully etching the remainder of the stock to the desired thickness.

The band is completed by welding the ends, preferably in the area of the blank spaces 40 between fonts. If the control indicia are destroyed in the area of the weld, a second transducer housing can be located exactly one font away from the first transducer housing so that pulses are provided by at least one set of transducers at all times.

The speed of movement of the band is determined by the length of a type font on the band and the desired printing speed. In the preferred embodiment, each font is eight inches long and a line is printed in about 0.25 seconds, so the band moves at a speed of about 32 inches per second.

Figure 3:
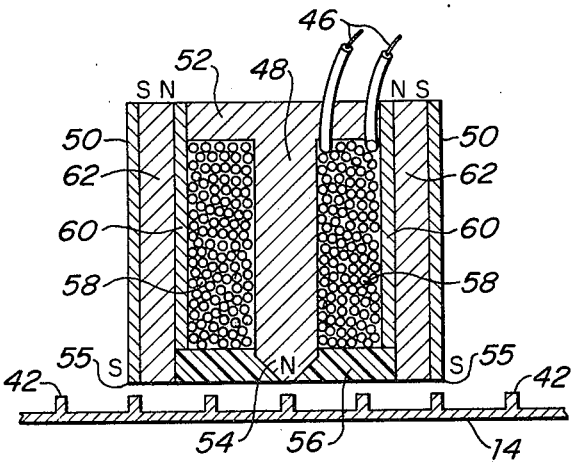
FIG. 3 is a cross-sectional view of a transducer.

While standard reluctance-type transducers can be used to sense the control indicia, higher signal levels and greater system stability are achieved using the transducers shown in FIGS. 2 and 3. As shown in FIG. 2, two transducers are mounted in the housing 21, one transducer is aligned with each row of control indicia to produce an electrical signal on its conductors 46 when a control indicia is centered beneath the transducer.

In the cutaway view of FIG. 3, the transducer contains an elongated center pole piece 48 and a cylindrical outer pole piece 50. The center pole piece is tack-shaped, containing a circular, disk-shaped portion 52 at one end and terminating in a pole 54 at the other end. The pole 54 is chisel-shaped with a tip that conforms to the shape of the control indicia. The outer pole piece 50 terminates in a circular pole 55. The disk-shaped portion 52 of the center pole piece 48 contains openings for the conductors 46. Both poles 48, 50 are constructed from soft-ferromagnetic material, such as iron. A nonmagnetic support 56 surrounds the pole 54 to provide a form to support a coil of insulated wire 58, terminating the leads 46.

The overall size of the transducer is not critical, but is preferably about 0.5 inch in diameter and about 0.5 inch in length. About 1000 turns of wire are used to form the coil.

The coil is surrounded by a ferromagnetic sleeve 60 which is preferably shorter in length than pole piece 48. A cylindrical permanent magnet 62 is located between the sleeve 60 and the outer pole piece 50. The magnet is shown with a length equal to the length of the pole pieces 48, 50, but may be shorter; eg, the length of the sleeve 60. The magnet is radially polarized to provide north (N) and south (S) poles as indicated on the drawing (or opposite to the indication on the drawing). The magnet is preferably of the type known as a "rubber magnet" which employs powdered barium ferrite vulcanized in rubber. Since the sleeve 60 abuts the disk-shaped portion 52 of the center pole piece, the arrangement produces two poles, 54, 55, enclosing the magnet and coil. In effect, the center pole piece 50 and the sleeve 60 form a single pole piece and can be constructed from a single piece of material.

Alternatively, the coil can be wound on a separate spool-shaped form which fits around the elongated portion of the center pole piece 48. In this case, the support 56 is not required.

This configuration of the transducer produces pulses which have a high amplitude for several reasons. The pole pieces are arranged to avoid undesirable flux leakage while concentrating the flux density in the region of the control indicia which are to be sensed. The arrangement of the coil insures that flux changes caused by the passage of the control indicia link all turns of the coil. Furthermore, the cylindrical magnet has a relatively large area contacting the pole pieces to produce a large magnetic field.

The transducer is shown in its relationship to the control indicia 42 on the band 14. The distance between the poles 54, 55 equals approximately 0.25 inch which is equal to double the distance between control indicia 42. Thus, the overall transducer covers five control indicia when pole 54 is centered on one of the indicia. The reluctance of the path between the poles depends upon the location of the carrier and is lowest when the control indicia are centered as shown in FIG. 3. As the indicia move past the transducer, a pulse of current is generated in the coil as a function of the change in reluctance between the poles 54, 55.

While the distance between the poles is not critical, it is preferably an integral multiple of the distance between control indicia, as shown in FIG. 3. In this case, the reluctance change is greatest when the control indicia pass the transducer. Since the effect of control indicia passing the outer pole 55 is much less than the effect upon the inner pole 54 (because the outer pole is circular and is adjacent to the carrier 14 about a much larger area than the small center pole), the transducer will perform satisfactorily even if the distance between poles is not an integral multiple of the distance between control indicia. For this reason, the transducer produces a sufficient output when used to sense the font indicia (in the center of the carrier), even though there are no indicia present near the outer pole 55 when the font indicia is beneath the center pole.

Another configuration of the transducer employs a forked center pole piece terminating in two (or more) chisel pointed poles. The distance between the poles equals the distance between the control indicia which are to be sensed. With this configuration, considerably larger pulses are generated as two (or more) indicia are simultaneously sensed and, even in the event that an indicia is missing (as may occur at the weld), the transducer will still supply a pulse, although of lesser amplitude. This feature can be advantageously employed with a single row of control indicia, omitting one indicia at a predetermined position for each font and detecting the relative amplitudes of the generated pulses to provide a font indication.

Figure 4:
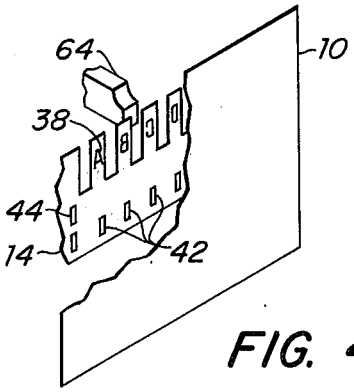
FIG. 4 is functional diagram of an alternate embodiment of the invention.

An alternate embodiment of the invention is shown in FIG. 4, where print hammers 64 and a band 14 are arranged on the same side of the document 10. In this embodiment, the band is further etched through its entire thickness between type elements to form a comb-shaped carrier with type arranged on the fingers of the comb. The control indicia 42, 44 and transducers are similar to the indicia described with respect to the embodiment of FIGS. 1, 2 and 3.

In the above-described embodiments of the invention, the transducer and its component parts are shown and described with the shape of a right circular cylinder. While this shape provides for simplicity of construction, other forms of cylinders can be employed.

For example, the transducer can be constructed with a square or rectangular cross-section and the sides of the transducer need not be perpendicular to the sensing surface. Regardless of the type of cylinder, optimum performance is achieved when the components of the transducer are concentric: eg, the centers of the outer pole and the magnet coincide with the center of the inner pole.

What is claimed is:

1. A printer font belt comprising a continuous flexible type carrier band adapted for movement around a closed path, said band having a plurality of raised type characters formed directly thereon at predetermined locations, said band further including a first set of control indicia arranged in a first raised row on said band, each respective indicia of said first set of control indicia physically located upon said band so as to correspond to the position of each of a respective type character, and a second set of control indicia arranged in a second raised row on said band, each respective indicia of said second set of control indicia physically located on said band so as to correspond to the position of a group of said type characters, said raised type characters, first set of raised control indicia, second set of raised control indicia, and said carrier band all formed of a single piece of homogeneous metal material.

2. The band of claim 1 wherein said material is steel.

3. The band of claim 1 wherein said carrier is provided with a comb shaped edge having said type characters formed on the teeth of said comb shaped edge.

4. In a printer, the combination comprising a font belt comprising a continuous magnetic stainless steel flexible type carrier band having a plurality of raised type characters formed directly thereon at predetermined locations, said band further including a first set of control indicia arranged in a first raised row on said band, each respective indicia of said first set of control indicia physically located upon said band so as to correspond to the position of each of a respective type character, and a second set of control indicia arranged in a second raised row on said band, each respective indicia of said second set of control indicia physically located on said band so as to correspond to the position of a group of said type characters, said raised type carriers, first set of raised control indicia, second set of raised control indicia, and said carrier band all formed of a single piece of said magnetic stainless steel, said first and second set of control indicia each having a thickness including said band thickness substantially exceeding thickness of said band taken alone, means for moving said band relative to a variable reluctance transducer means positioned adjacent said band control indicia sets for sensing the position of said control indicia, said transducer means magnetically sensing respective ones of said raised control indicia for providing signals indicative of the position of respective ones of said type characters.

5. The printer of claim 4 wherein said first and second set of control indicia is raised from said band by a distance about twice the thickness of said band alone.

6. The combination of claim 4 wherein said belt includes a plurality of repetitive fonts and a plurality of transducer means, each transducer means positioned with respect to each of said plurality of fonts so that at least one set of pulses are produced from one of said transducer means.

* * * * *

UNITED STATES PATENT AND TRADEMARK OFFICE

CERTIFICATE OF CORRECTION

PATENT NO. : 3,999,478

DATED : December 28, 1976

INVENTOR(S) : Richard Holzman

It is certified that error appears in the above-identified patent and that said Letters Patent are hereby corrected as shown below:

Column 2, line 60, delete "identify" and insert --identity--.

line 66, after "40 " insert --)--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*